US010902792B2

(12) United States Patent
Dupont

(10) Patent No.: US 10,902,792 B2
(45) Date of Patent: Jan. 26, 2021

(54) SYSTEM AND METHOD FOR IMAGE DISPLAY INCLUDING DATA STORAGE USING PIXELS

(71) Applicant: COMMISSARIAT A L'ENERGIE ATOMIQUE ET AUX ENERGIES ALTERNATIVES, Paris (FR)

(72) Inventor: Bertrand Dupont, Grenoble (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 0 days.

(21) Appl. No.: 16/375,422

(22) Filed: Apr. 4, 2019

(65) Prior Publication Data

US 2019/0311681 A1 Oct. 10, 2019

(30) Foreign Application Priority Data

Apr. 5, 2018 (FR) ..... 18 52972

(51) Int. Cl.

| | |
|---|---|
| ***G09G 3/3283*** | (2016.01) |
| ***G09G 3/3233*** | (2016.01) |
| ***G09G 3/20*** | (2006.01) |
| ***G09G 3/3225*** | (2016.01) |
| ***G09G 3/32*** | (2016.01) |

(52) U.S. Cl.

CPC ..... *G09G 3/3283* (2013.01); *G09G 3/2022* (2013.01); *G09G 3/2092* (2013.01); *G09G 3/32* (2013.01); *G09G 3/3225* (2013.01); *G09G 3/3233* (2013.01); *G09G 2300/0828* (2013.01); *G09G 2300/0857* (2013.01);

(Continued)

(58) Field of Classification Search

None

See application file for complete search history.

(56) References Cited

U.S. PATENT DOCUMENTS

| | | | |
|---|---|---|---|
| 10,223,961 | B2 | 3/2019 | Segura Puchades |
| 2002/0000982 | A1 | 1/2002 | Takagi |

(Continued)

FOREIGN PATENT DOCUMENTS

| | | |
|---|---|---|
| FR | 3 034 902 | 10/2016 |
| WO | WO 02/069259 A2 | 9/2002 |

OTHER PUBLICATIONS

French Preliminary Search Report dated Jul. 23, 2018 in French Application 18 52972 filed on Apr. 5, 2018 (with English Translation of Categories of Cited Documents).

*Primary Examiner* — Aneeta Yodichkas

(74) *Attorney, Agent, or Firm* — Oblon, McClelland, Maier & Neustadt, L.L.P.

(57) ABSTRACT

A display device comprising a matrix of pixels each one comprising:

a display unit displaying a binary word of the BCM type encoded over N bits, with N a whole number greater than or equal to 2, a storage unit storing at least three bits, further comprising a sequencing unit outputting to the storage unit of each pixel, during the display of a first image:

a storage signal of at least two bits of the binary word of a second image to be displayed after the first image and/or of the binary word of the first image, a display signal triggering successive sendings of the stored bits to the display unit, wherein the storage is triggered during at least one portion of the display of at least one bit of the binary word of the first image.

19 Claims, 7 Drawing Sheets

(52) U.S. Cl.
CPC ..... *G09G 2300/0861* (2013.01); *G09G 2310/0286* (2013.01); *G09G 2350/00* (2013.01)

(56) References Cited

U.S. PATENT DOCUMENTS

| | | | | |
|---|---|---|---|---|
| 2002/0012008 | A1 | 1/2002 | Takagi | |
| 2002/0017962 | A1 | 2/2002 | Takagi | |
| 2005/0083274 | A1 | 4/2005 | Beddes et al. | |
| 2016/0300525 | A1* | 10/2016 | Segura Puchades | G09G 3/3233 |
| 2018/0197471 | A1* | 7/2018 | Rotzoll | G09G 3/2007 |

* cited by examiner

SYSTEM AND METHOD FOR IMAGE DISPLAY INCLUDING DATA STORAGE USING PIXELS

TECHNICAL FIELD AND PRIOR ART

The invention relates to an image display device comprising an active matrix of pixels controlled by binary code modulation (BCM), as well as a method for image display, wherein a storage of the signals of pixels, or binary words, to be displayed is carried out within the matrix of pixels, in each pixel.

In a conventional active matrix screen, each pixel comprises at least one transistor that controls the display of a light signal by the pixel. A storage capacity (or the parasite capacity of the gate of the transistor) is also integrated into the pixel in order to maintain during a display period a data voltage that makes it possible to obtain the desired light intensity. When the light display is carried out by light-emitting diodes, each pixel may comprise at least one second transistor that electrically supplies the light-emitting diode of the pixel according to the data voltage.

The light-emitting diodes of the screen may require high polarisation voltages. This is the case in particular with light-emitting diodes made with GaN which, due to their high variability at low polarisation, are used only with a high polarisation (in voltage or in current), and therefore emit light signals only with a strong luminance.

With such light-emitting diodes, the display of an image is controlled in binary fashion (each light-emitting diode is turned off or emits with a strong light intensity), and the control of the brightness of each pixel, during the display of each image, is carried out by controlling the ratio between the duration during which the light-emitting diode is turned on and the total display duration of the image on the screen. Such a control of the light-emitting diodes can be obtained by using binary words, (i.e. a binary code over a certain number of bits that makes it possible to control the display of the image) of the BCM type in which the brightness of each pixel is encoded in the form of a binary signal. Each bit of such a binary word controls the turning on or the turning off of one of the light-emitting diodes during a duration that is proportional to the weight of the bit. For example, the most significant bit (MSB) controls the light-emitting diode during half of the display duration of the image (for example 10 ms for a display device operating at a frequency of 50 images/second). The following bit (named MSB-1) represents a quarter of this duration, and so on until the least significant bit (named LSB). During the display of an image, it is possible that all of the pixels simultaneously display a bit of the same weight.

With this type of control signals, it is necessary to access each pixel N times per image, with N corresponding to the number of bits of the BCM signal, in order to successively write, in each pixel, the N bits of the signal of the pixel. However, during the display of the LSB of the binary words transmitted to all of the pixels, the duration available for writing in all of the pixels the following bit is less than or equal to the display duration of the LSB. The frequency with which all of the pixels have to be addressed at that moment can then be problematic.

Document FR 3 034 902 propose a solution to this problem which consists, during the display of an image, in writing on all of the lines of the screen not the bit of the same weight, but bits of different weights. Thus, at a display instant of an image, certain lines of pixels display the MSB of the binary words, other lines of pixels display the MSB-1 of the binary words, etc. This makes it possible to reduce the addressing frequency of the pixels since during the display of an image, only a portion of the lines of pixels simultaneously display the LSB of the binary words of these lines and only these lines require being addressed rapidly after the display duration of the LSB on the pixels of these lines. The method proposed in this document also has for advantage to render homogeneous the frequency with which the lines of pixels are addressed since, at the same instant, the display durations of the bits are different from one line of pixels to the other and the weights of the bits displayed are chosen so as to balance the number of lines of pixels to be addressed all throughout the display duration of the image.

The method proposed in document FR 3 034 902 has however for disadvantage that the simultaneous display of bits of different weights of the signals of the same image involves carrying out a storage beforehand of all of the bits of the binary words of all of the pixels of the image, as well as all of those of the following image intended to be displayed. In addition, this method requires using non-standard line addressing control blocks. Furthermore, with this method, the video flow sent to the pixels is constant only when the number of lines of the screen is equal to a multiple of $2^n$, with n corresponding to the number of bits of the binary words used, which is rarely the case. When the number of lines of the screen is not equal to a multiple of $2^n$, "dead time" during which no line of pixels is addressed is therefore required.

DISCLOSURE OF THE INVENTION

There is therefore a need to propose an image display device that does not have the disadvantages of the display devices of prior art and that makes it possible to operate with few interconnections between the pixels and the pixel control elements (lines and columns).

For this, an image display device is proposed comprising at least one matrix of pixels, wherein each pixel comprises at least:

one display unit configured to emit, during the display by the matrix of pixels of an image encoded in the form of several binary words of the BCM type comprising N bits, with N a whole number greater than or equal to 2, at least one light signal for a duration that corresponds to a value encoded in one of the binary words of the image, with each one of the N bits of said one of the binary words of the image representing a duration of the display of the light signal that is proportional to the weight of the bit, one storage unit configured to store at least three bits, comprising an output coupled with an input of the display unit, and an input configured to receive the binary words of the images to be displayed by said display unit, the image display device further comprising a sequencing unit configured to output to the storage unit of each pixel, during the display of a first image by the matrix of pixels:

a storage signal that triggers, during the display of one of the bits of one of the binary words of the first image by the display unit of the pixel, a storage of at least two other bits of one of the binary words of a second image intended to be displayed after the first image and/or of said one of the binary words of the first image (i.e. at least two other bits of one of the binary words of the second image and/or at least two other bits of said one of the binary words of the first image), in said storage unit of the pixel, a display signal that triggers the successive sending of each one of the bits of said one of the binary words of the first image stored in the storage unit of the pixel to the display unit of the pixel.

An image display device is also described comprising at least one matrix of pixels arranged by forming several lines and several columns of pixels, wherein each pixel comprises at least:

one display unit configured to emit, during the display of an image formed from several binary words of the BCM type encoded over N bits, with N a whole number greater than or equal to 2, a light signal indicative of one of the binary words, one storage unit configured to store at least three bits, further comprising a sequencing unit configured to output to the storage unit of each pixel, during the display of a first image:

a storage signal that triggers a storage of at least two bits of the binary word of a second image intended to be displayed after the first image and/or of the binary word of the first image in the storage unit of the pixel, a display signal that triggers successive sendings of each one of the bits stored in the storage unit to the display unit, and wherein the display and storage signals are such that the storage of said at least two bits of the binary word of the second image and/or of the binary word of the first image is triggered during at least a portion of the display of at least one bit of the binary word of the first image.

In this display device, the storage of the binary words to be displayed is carried out directly in the pixels, in storage units integrated into the pixels. In addition, the sequencing unit is configured to carry out the storage of at least some of the bits of the binary words of an image during the display of preceding bits and/or the display of a preceding image. Thanks to this configuration, it is possible to carry out, for each pixel, the storage of at least a portion of a binary word of an image during the display of one or several preceding bits of this binary word and/or during the display of one or several bits of a binary word of the preceding image. By carefully choosing the bit or bits during which the storing is triggered, the duration available to carry out this storing can therefore be more substantial than that allowed in the display devices of prior art, which makes it possible to reduce the frequency with which the pixels have to be addressed.

The storage unit and the display unit are part of the pixel, i.e. are made on the same substrate and are arranged on a limited surface of the substrate corresponding to the surface of a pixel.

This reduction in the addressing frequency of the pixels is particularly interesting when the image display device forms a screen of substantial dimensions, for example with a diagonal equal to 1 or several metres. Using the device to form screens of large size is also advantageous because it makes it possible to limit the number of wires required linked to the pixels.

In addition, this image display device does not require carrying out a full storage of two successive images.

The expression "addressing frequency of pixels" designates the frequency of the sending of the binary words to the pixels, i.e. after the decompression of a video flow received by the display device.

The binary words may correspond to signals that, together, form a complete image that occupies entirely or a portion only of the surface of the screen of the display device, or are associated with a portion or all of the lines of the display device (the image may correspond to a frame).

This display device makes it possible to limit the number of interconnections connected to each pixel, with however as a counterparty a surface occupied by the elements that form these pixels that can be more substantial according to the elements used. This more substantial occupied surface is not however a disadvantage when the display device corresponds to a screen of large size.

Advantageously, the display unit of each pixel comprises at least one light-emitting diode comprising GaN. Using such light-emitting diodes in this display device is advantageous because they are entirely compatible with a display of binary words of the BCM type, and in addition offer a substantial free semi-conductor surface around and/or below them in order to allow for the carrying out of the storage unit within each pixel.

Said one of the bits of one of the binary words of the first image may advantageously correspond to the most significant bit of said one of the binary words of the first image. In other words, the sequencing unit may be configured to trigger the storage during the display of the most significant bit of said one of the binary words of the first image. Thus, the duration available for carrying out the storage corresponds to half of the display duration of the first image. The device can in this case operate in an interlaced mode. For example, during a duration that corresponds to a first half of the display duration of an image, the binary words may be sent to the even lines of pixels, and during the second half of the display duration of an image, the binary words may be sent to the odd lines of pixels. Thus, the flow of the binary words sent to the pixels can be substantially constant.

Generally, this device can be applied regardless the order wherein the bits of the binary words arrive in the storage unit of each pixel.

The storage unit of each pixel may comprise at least three flip-flops coupled in series to one another and such that an input from a first of the flip-flops is coupled to an input of the pixel intended to receive the binary words, and such that an output from a last of the flip-flops is coupled to an input of the display unit. Such a storage unit is particularly advantageous because the number of flip-flops required for the carrying out thereof is limited. These flip-flops form a shift register wherein the bits to be displayed are sequentially stored in the flip-flops.

The image display device may be such that:

the sequencing unit outputs on a single output the display signal and the storage signal in the form of a single and same signal named display and storage signal, said output being coupled to a control input of each one of at least two first flip-flops of the storage unit corresponding to those, among the flip-flops of the storage unit, in which said at least two other bits of one of the binary words of the second image and/or of said one of the binary words of the first image are stored during said display of one of the bits of one of the binary words of the first image, the storage unit of each pixel further comprises at least one multiplexer comprising two data inputs, of which one is coupled to the output of the sequencing unit on which the display and storage signal is intended to be outputted and of which the other is coupled to a reference electric potential, one control input coupled to a third output of the sequencing unit on which a selection signal is intended to be sent and making it possible to couple the output of the multiplexer to one or the other of the two data inputs of the multiplexer according to the value of the selection signal, and an output coupled to a control input of the last of the flip-flops of the storage unit, the sequencing unit is configured such that, for each pixel, the selection signal controls the multiplexer such that during said display of one of the bits of one of the binary words of the first image, the reference electric potential is outputted on the output of the multiplexer while the display and storage signal applied on the control input of each one of the first flip-flops of the storage unit triggers the storage of said at least two other bits of one of the binary words of the second image and/or of said one of the binary words of the first image, and for the display of the other stored bits, the display and storage signal is applied on the control inputs of the flip-flops of the storage unit and triggers the successive displays of each one of the other stored bits.

In the sequencing unit, the display and storage signal may be obtained at the output of an OR gate that receives as input the display signal and the storage signal.

According to an alternative embodiment, in each pixel, the output of the last of the first flip-flops of the storage unit of the pixel may be coupled to the input of the first of the flip-flops of the storage unit of the pixel through a switch controlled by the sequencing unit which is configured to close the switch when the binary word of the first image is similar to the binary word of the second image. This switch may also be controlled by the selection signal (which may be common to a line of pixels or own to the pixel). In this case, when the selection signal is at zero, the re-looping is active, and at each pulse of the display and storage signal, the data is displaced but is stored in one of the flip-flops. If there is no change between two successive images, then the selection signal remains at zero and after N pulses of the display and storage signal (for example 8 for 8 bits stored), the binary word of the preceding image is retrieved.

The device may be such that:

the storage unit is configured to store at least N+1 bits; and during said display of one of the bits of one of the binary words of the first image, the storage signal triggers the storage of the N bits of the binary word of the second image or the storage of N−1 following bits of the binary word of the first image and of one bit of the binary word of the second image.

Alternatively, when the storage unit of each pixel does not have a storage capacity that is at least equivalent to the number of bits of each binary word, only some of the bits of the binary words of an image are stored during the display of a bit, with the other bits being stored during the display of one or several other bits of this word.

Also proposed is a method for image display by an image display device comprising at least one matrix of pixels arranged by forming several lines and several columns of pixels, carrying out a successive display of images each one formed from several binary words of the BCM type encoded over N bits, with N a whole number greater than or equal to 2, each pixel displaying, during the display of an image, one of the binary words, the method comprising, during the display of a first image and for each pixel, a storage, in a storage unit arranged in the pixel, of at least two bits of the binary word of a second image intended to be displayed after the first image and/or of the binary word of the first image, triggered during at least a portion of the display of at least one bit of the binary word of the first image.

Also proposed is a method for image display by an image display device comprising at least one matrix of pixels, carrying out a successive display of images each one encoded in the form of several binary words of the BCM type encoded over N bits, with N a whole number greater than or equal to 2, each pixel displaying, during the display of an image, a light signal for a duration that corresponds to a value encoded in one of the binary words of the image, with each one of the N bits of said one of the binary words of the image representing a display duration that is proportional to the weight of the bit, the method comprising, during the display of one of the bits of one of the binary words of the first image by the display unit of the pixel and for each pixel, a storage, in a storage unit arranged in the pixel and comprising an input configured to receive the binary words of the images to be displayed, of at least two other bits of one of the binary words of a second image intended to be displayed after the first image and/or of said one of the binary words of the first image.

The display signal and the storage signal may correspond to, or be combined in, a single display and storage signal.

When the binary word is intended to be the same in the first and second images, the bits of the binary word of the first image may be stored again in the storage unit in order to form the binary word of the second image.

The method for image display may be such that:

the storage unit is configured to store at least N+1 bits; and during said display of one of the bits of one of the binary words of the first image, the storage signal triggers the storage of the N bits of the binary word of the second image or the storage of N−1 bits of the binary word of the first image and of one bit of the binary word of the second image.

BRIEF DESCRIPTION OF THE DRAWINGS

This invention shall be better understood when reading the description of embodiments given purely for the purposes of information and in a non-limiting manner in reference to the accompanying drawings wherein.

Identical, similar or equivalent portions of the various figures described hereinafter bear the same numerical references in order to facilitate passing from one figure to another.

The various portions shown in the figures are not necessarily shown according to a uniform scale, in order to render the figures more legible.

The various possibilities (alternatives and embodiments) must be understood as not being exclusive of one another and can be combined together.

DETAILED DISCLOSURE OF PARTICULAR EMBODIMENTS

Figure 1:
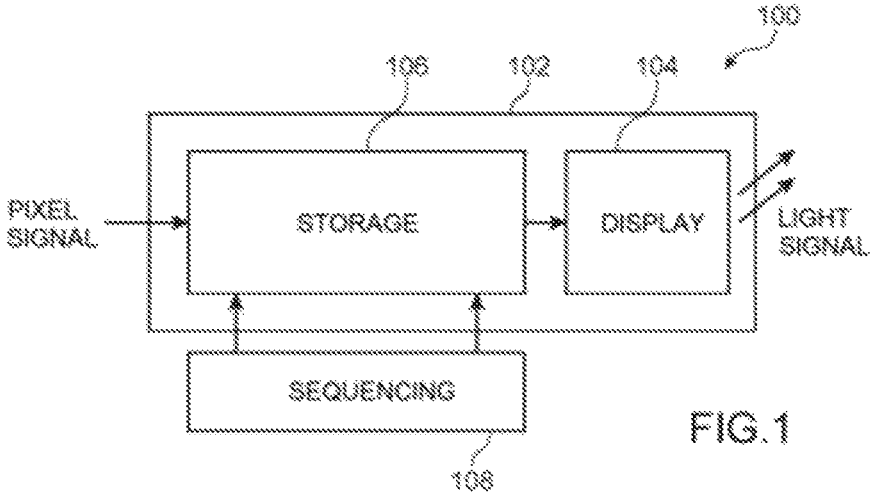
FIGS. 1 and 2 diagrammatically show a portion of an image display device according to a particular embodiment.

Reference is first made to FIG. 1 that diagrammatically shows, in the form of functional blocks, a portion of an image display device 100, and in particular one of the pixels 102 of the device 100 as well as a sequencing unit 108 to which the pixels 102 are coupled.

The pixel 102 comprises a display unit 104 configured to emit, during the display of an image formed from several binary words, at least one light signal indicative of at least one binary word that the pixel 102 receives. This display unit 104 comprises for example a light-emitting diode, and for example of the LED (light-emitting diode) or μLED (micro-light-emitting diode) type, made using GaN, coupled to a control element comprising for example at least one MOS transistor configured to electrically supply the light-emitting diode according to a binary display signal received as input from the display unit 104. Various embodiments of a light-emitting diode coupled to such a control element are for example described in document FR 3 034 902.

The binary words received by the pixels 102 are of the BCM type and are encoded over N bits, N being a whole number greater than or equal to 2. Thus, in order to carry out the display of each image, each pixel 102 receives as input a binary word encoded over N bits, with for example N between 6 and 10 bits and for example equal to 8 bits, in which is encoded the duration during which the display unit 104 of the pixel 102 must emit a light signal.

The binary word is binary, which means that the display unit 104 is controlled in binary fashion. With a display signal of a pixel of the BCM type, the light signal is emitted by the display unit 104 of each pixel 102, for each bit of the binary word received, during a duration that is proportional to the weight of each one of these bits. Thus, the most significant bit, also named MSB, of the binary word of an image controls the emitting or not of the light signal during a duration equal to half of the display duration of the image (for example 5 ms for a device 100 operating at a frequency of 100 images/second). The following bit, named MSB-1, represents a quarter of this duration, and so on until the least significant bit, named LSB.

The pixel 102 also comprises a storage unit 106 configured to store at least two bits of the binary word received as input from the pixel 102. In the various embodiments described hereinafter, the storage unit 106 of each pixel 102 is configured to store N+1 bits. However, the storage capacity of the storage unit 106 of each pixel 102 is adapted in particular according to the space available in each pixel 102 for the making of the storage unit 106.

The storage unit 106 receives as input a storage signal sent from a sequencing unit 108. The storage unit 106 is configured to store at least some of the bits of the binary word applied on the input of the storage unit 106, on the control of the storage signal.

The storage unit 106 also receives as input a display signal sent from the sequencing unit 108. The storage unit 106 is configured to successively send on the input of the display unit 104 each one of the stored bits, on the control of the display signal.

Figure 2:
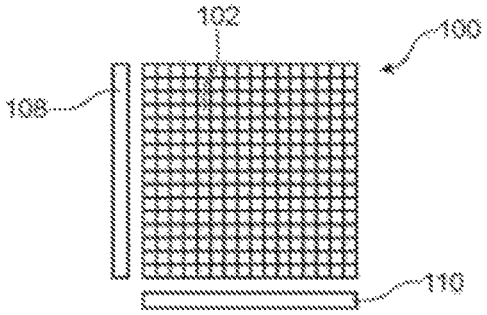

The pixel 102 shown in FIG. 1 corresponds to one of the pixels of the device 100 diagrammatically shown in FIG. 2, on which the pixels 102 are arranged by forming a matrix of several lines and several columns of pixels 102.

The device 100 may correspond to a monochrome screen or a colour screen. A device 100 corresponding to a colour screen may comprise a matrix of "colour pixels" each one formed by the juxtaposition of several pixels 102 adapted to emit light signals of different colours. Each one of the pixels 102 is for example associated with a coloured filter, or comprises at least one light-emitting diode of which the materials allow for a light emission at the desired wavelength, or is associated with a wavelength conversion element. Each pixel 102 receives a binary word indicative of the brightness to be displayed for the colour associated with the pixel 102 during the display of an image. Alternatively, several pixels 102 may form together a module that is able to emit a colour light signal and receiving, on an input, the binary words intended for the pixels of the module.

The device 100 also comprises a register 110 that sends to the pixels 102, through data lines each one coupled to the pixels 102 of the same column, the binary words. The addressing of the lines of the matrix of pixels 102 is for example carried out by the sequencing unit 108.

Figure 11:
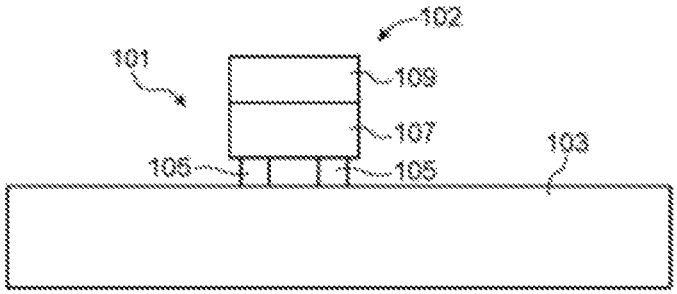

As indicated hereinabove, the display unit 104 of each pixel 102 advantageously comprises one or several light-emitting diodes made using GaN and coupled to a control element of the CMOS type configured in particular to electrically supply the light-emitting diode or diodes according to one or several binary display signals received as input on the display unit 104. FIG. 11 diagrammatically shows an embodiment of a pixel 102. Each pixel 102 is made in the form of a module 101 made and hybridised on a substrate 103 used as a support, by electrical and mechanical connection elements 105. These elements 105 correspond for example to microbeads, micro-tubes, or to portions of metal materials integral with one another by direct gluing (comprising copper for example).

The module 101 corresponding to each pixel 102 comprises a first portion 107 located on the side of the substrate 103 and forming an electronic circuit for example made in CMOS technology, comprising in particular the storage unit 106 of the pixel 102 as well as the control element of the diode of the pixel 102 (which controls the light emission of the pixel 102). This first portion 107 is for example made using silicon or any other semi-conductor suitable for the making of MOS transistors.

The module 101 also comprises a second portion 109 forming the display unit 104 of the pixel 102 and made using the semi-conductor corresponding to the emissive material of the diode or of the diodes of the pixel 102, here advantageously GaN.

The modules 101 corresponding to the pixels 102 are made collectively using a semi-conductor wafer whereon the electronic components, in particular the MOS transistors, of the first portion 107 of each module 101 are made. The emissive material, for example GaN, is then deposited over the entire wafer comprising the first portions 107 of the modules 101. The second portions 109 are then made in order to form the display units 104 of the pixels 102. The wafer is then cut in order to individually separate the modules 101. The modules 101 are then hybridised on the substrate 103.

Figure 12:
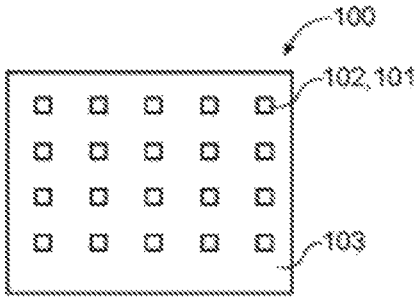

When the display units 104 comprise GaN diodes, the high luminance of these diodes makes it possible to make the modules with reduced dimensions. After the hybridisation therefore on the substrate 103, the modules 101 forming the pixels 102 are spaced apart from one another by a distance for example greater than or equal to the dimensions of one or several modules 101, such as is diagrammatically shown in FIG. 12.

Making such pixels 102 with reduced dimensions represents substantial savings in cost. However, this entails that the space available for making the various CMOS components within the first portion 107 of the modules 101 is limited. In addition, a large portion of this space is occupied by the conductor vias that correspond to the elements 105. In order to limit the space occupied by these vias, the semi-conductor wafer on which the first portions 107 of the modules 101 are made is thinned, for example with a thickness of about 10 μm, which makes it possible to reduce the dimensions of the sections of the vias.

The various elements of the device 100 described hereinbelow makes it possible to satisfy this constraint, i.e. allow for an operation of the pixels 102 with few interconnections between the pixels 102 and the pixel control elements 102.

Alternatively, it is also possible to have a portion of the electronics for controlling and/or for storing pixels that is formed by chips that are independent from the modules 101 and hybridised on the substrate 103 next to the modules 101.

The pixels 102 are here arranged in lines and in columns. In addition, the conductive lines on which the signals circulate may be common to the pixels 102 that belong to the same line or to the same column. For example, it is possible to have a wire that is common to all of the pixels 102 of the same column and on which the signals of pixels (of which the bits correspond to the images to be displayed) are sent, as well as wires that are common to all of the pixels of the same line and on which the control signals are sent.

By considering a device 100 operating at a frequency of 100 images/second, of which the screen is formed by 1080 lines of pixels and 1920 columns of pixels, and binary words each one encoded over 8 bits, the data throughput of the binary words is 1660 Mb/s, considering this flow of data as being constant. Given that the binary words are sent in parallel on the columns of pixels 102 by the register 110, the data throughput on each column of pixels is therefore 864 Kb/s.

The sequencing unit 108 is configured so that the storage and display signals sent to the storage unit 106 are such that, during at least a portion of the display of at least one bit of the binary word of a first image, at least two bits of the binary word of a second image intended to be displayed after the first image and/or of the binary word of the first image (received therefore after the bit displayed) are stored in the storage unit 106. When the storage unit 106 of each pixel 102 is configured to store N+1 bits, N bits of the binary word of the second image, or N−1 bits of the binary word of the first image and one bit of the binary word of the second image, are stored in the storage unit 106.

Figure 3:
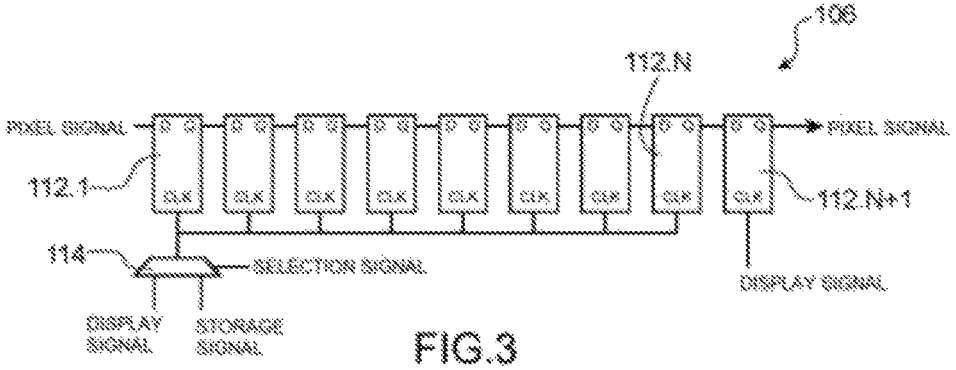
FIG. 3 shows an embodiment of a storage unit of a pixel of an image display device according to a first embodiment.

FIG. 3 shows an embodiment of the storage unit 106 of each pixel 102 of the device 100 according to a first embodiment.

The storage unit 106 comprises N+1 flip-flops 112 coupled in series to one another. These flip-flops correspond for example to D flip-flops. A first of these N+1 flip-flops 112, referenced as 112.1 in FIG. 3, comprises a data input on which the binary word received as input on the pixel 102 is sent. The output of a last of the N+1 flip-flops 112, referenced as 112.N+1 in FIG. 3, is coupled to an input of the display unit 104. In the example of FIG. 3, the storage unit 106 comprises 9 flip-flops 112, the binary words received by the pixel 102 each one comprising 8 bits (N=8) intended to be stored by the storage unit 106.

The storage unit 106 of the pixel 102 also comprises a multiplexer 114 comprising two data inputs coupled to the sequencing unit 108. One of these two inputs is coupled to a first output of the sequencing unit 108 on which the display signal is sent. The other of these two inputs is coupled to a second output of the sequencing unit 108 on which the storage signal is sent. The multiplexer 114 also comprises one control input coupled to a third output of the sequencing unit 108 on which a selection signal is sent. Finally, the output of the multiplexer 114 is coupled to a control input of each one of N first flip-flops 112, i.e. the flip-flops 112.1 to 112.N. Here, only the control input of the last flip-flop 112.N+1 is not coupled to the output of the multiplexer 114. The control input of the last flip-flop 112.N+1 is coupled to the first output of the sequencing unit 108 on which the display signal is outputted.

According to a first configuration of the device 100 comprising the storage unit 106 shown in FIG. 3, the display and storage signals may be such that during at least a portion of the display of a bit of the binary word of a first image, here the MSB of this binary word, the storage of the N−1 other bits of the binary word of the first image and of a bit of the binary word of a second image intended to be displayed after the first image, here the MSB of the binary word of the second image, is triggered. In this first configuration, the binary words received by the pixels 102 are such that the N bits of each binary word sent successively, in series, to the input of the storage unit 106, are ordered such that the weight of the bits received is decreasing with the order of arrival on the input of the storage unit 106, and therefore that the MSB of the binary word is received first and that the LSB of the binary word is received last on the input of the storage unit 106.

Figure 4:
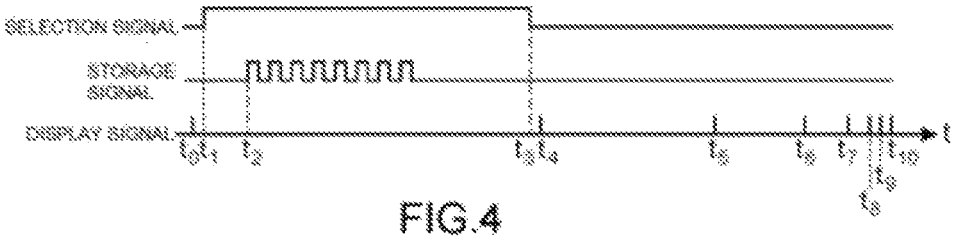
FIGS. 4 and 5 show chronograms of signals used in the image display device according to the first embodiment.

The chronogram shown in FIG. 4 corresponds to the selection, storage and display signals sent by the sequencing unit 108 to the storage unit 106 in this first configuration. At an instant t0, a pulse of the display signal triggers the shift of the MSB of the binary word of the first image from the flip-flop 112.N to the flip-flop 112.N+1. The pixel 102 sends or does not send, during the duration that corresponds to this MSB (corresponding to the interval of time between the instants t0 and t4 shown in FIG. 4), a light signal. During this display duration of the MSB of the binary word of the first image, at the instant t1, the selection signal changes value so that the storage signal is transmitted on the control inputs of the N flip-flops 112.1 to 112.N. Still during this display duration of the MSB of the binary word of the first image, at the instant t2, the storage signal comprises 8 pulses triggering the storage, in the N flip-flops 112.N to 112.1, of the remaining 7 bits (from the MSB-1 to the LSB) of the binary word of the first image as well as of the MSB of the binary word of the second image. The MSB-1 of the binary word of the first image is stored in the flip-flop 112.N, the LSB of the binary word of the first image is stored in the flip-flop 112.2, and the MSB of the binary word of the second image is stored in the flip-flop 112.1. At an instant t3, the selection signal changes value so that the display signal is again transmitted on the control inputs of the N flip-flops 112.1 to 112.N. Pulses of the display signal appearing at instants t4 to t10 cause the shift of the bits stored in the flip-flops 112.1 to 112.N so that each one of these bits is stored in the flip-flop 112.N+1 during the duration that corresponds to the weight of each one of these bits (from the MSB-1 to the LSB). Starting from the instant t10, the sequence of the signals described hereinabove starts again by using the binary words of the following image.

According to a second configuration of the device 100 comprising the storage unit shown in FIG. 3, the display and storage signals may be such that during at least a portion of the display of a bit of the binary word of a first image, here the MSB of this binary word, the storage of the N bits of the binary word of the second image intended to be displayed after the first image is triggered. In this second configuration, the binary words received by the pixels 102 are such that the N bits of each binary word sent successively, in series, to the input of the storage unit 106, are ordered such that the weight of the bits received is increasing with the order of arrival on the input of the storage unit 106, and therefore that the LSB of the binary word is received first and that the MSB of the binary word is received last on the input of the storage unit 106.

Figure 5:
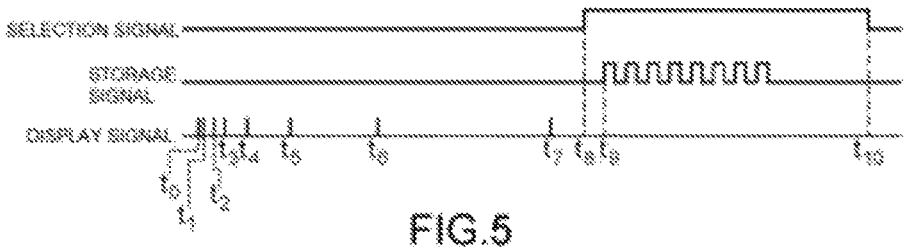

The chronogram shown in FIG. 5 corresponds to the selection, storage and display signals sent by the sequencing unit 108 to the storage unit 106 in this first configuration. In this configuration, before the instant t0, the N bits of the binary word of the first image are stored in the flip-flops 112.1 to 112.N. Pulses of the display signal appearing at instants t0 to t6 cause the shift of the bits stored in the flip-flops 112.1 to 112.N so that each one of these bits is stored in the flip-flop 112.N+1 during the duration that corresponds to the weight of each one of these bits (from the LSB to the MSB-1). At the instant t7, a pulse of the display signal triggers the shift of the MSB of the binary word of the first image from the flip-flop 112.N to the flip-flop 112.N+1. During this display duration of the MSB of the binary word of the first image, at the instant t8, the selection signal changes value so that the storage signal is transmitted on the control inputs of the N flip-flops 112.1 to 112.N. Still during this display duration of the MSB of the binary word of the first image, at the instant t9, the storage signal comprises 8 pulses triggering the storage, in the N flip-flops 112.N to 112.1, of the 8 bits (from the LSB to the MSB) of the binary word of the second image. The LSB of the binary word of the second image is stored in the flip-flop 112.N and the MSB of the binary word of the second image is stored in the flip-flop 112.1. At the instant t10, the selection signal changes value so that the display signal is again transmitted on the control inputs of the N flip-flops 112.1 to 112.N. Starting from the instant t10, the sequence of the signals described hereinabove starts again by using the binary words of the following image of which the N bits will be stored during the display of the MSB of the second image.

As an alternative of the first embodiment described hereinabove, the storage unit 106 of each pixel 102 may comprise a number of flip-flops 112 less than N+1 and greater than or equal to 3.

As an example, by considering binary words identical to those described hereinabove, i.e. each one comprising 8 bits, the storage unit 106 of each pixel 102 may comprise 5 flip-flops 112.1 to 112.5. In this case, during the display of the $1^{st}$ bit (for example the MSB) stored in the last flip-flop 112.5, the following four bits ($2^{nd}$, $3^{rd}$, $4^{th}$ and $5^{th}$ bits of the binary word) are stored in the four other flip-flops 112.1 to 112.4. Then, after the display of the $2^{nd}$, $3^{rd}$ and $4^{th}$ bits of the binary word, and during the display of the $5^{th}$ bit which is then stored in the last flip-flop 112.5, the last three bits of the binary word as well as the $1^{st}$ bit of the binary word of the following image are stored in the four flip-flops 112.1 to 112.4. In this example, the bits of each binary word are therefore stored during two successive storage phases.

The embodiment given hereinabove may be applied for a different number of flip-flops 112 and/or for binary words that have a different number of bits. This example may be applied for binary words wherein the first bit received in the storage unit 106 corresponds to the most significant bit as well as for binary words wherein the first bit received in the storage unit 106 corresponds to the least significant bit, or any other order of arrival of the bits.

In the first embodiment described hereinabove, the display unit 104 comprises a single light-emitting diode and the storage unit 106 comprises a single input configured to receive the binary words of the images to be displayed and three control inputs whereon the display signal, the storage signal and the selection signal are received.

Figure 6:
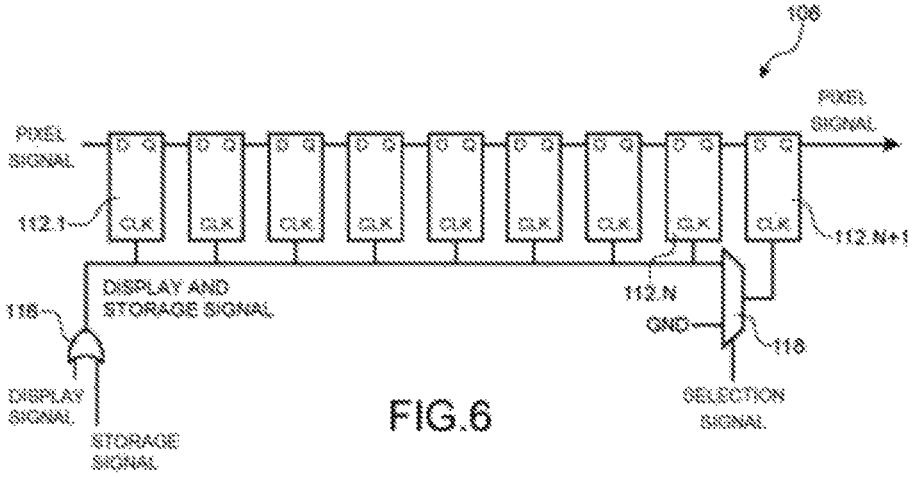
FIG. 6 shows an embodiment of a storage unit of a pixel of an image display device according to a second embodiment.

FIG. 6 shows an embodiment of the storage unit 106 of each pixel 102 of the device 100 according to a second embodiment.

As in the first embodiment shown in FIG. 3, the storage unit 106 comprises the N+1 flip-flops 112.

The display and storage signals are combined to form a single and same display and storage signal. This combination is for example carried out by an OR gate 116 that receives on each one of its two inputs one of the display and storage signals. The OR gate 116 may be formed within the sequencing unit 108 or outside of the sequencing unit 108. The display and storage signal obtained as output from the OR gate 116 is sent to a control input of each one of the N first flip-flops 112.1 to 112.N. Here, only the control input of the last of the N+1 flip-flops 112.N+1 does not receive the display and storage signal.

The storage unit 106 also comprises a multiplexer 118 comprising two data inputs of which one receives the display and storage signal and of which the other is coupled to a reference electric potential, for example the ground named GND. The multiplexer 118 also comprises a control input coupled to the third output of the sequencing unit on which the selection signal is sent. The output of the multiplexer 118 is coupled to the control input of the last flip-flop 112.N+1.

As in the first embodiment, the display unit 104 comprises here a single light-emitting diode and the storage unit 106 comprises a single input configured to receive the binary words of the images to be displayed.

During the display phase of the bits LSB to MSB-1, the display and storage signal is sent on the control input of the N+1 flip-flops 112 and the pulses coming from the initial display signal which are received by the flip-flops 112.1 to 112.N+1 shift the bits stored in these flip-flops in the direction from the first flip-flop 112.1 to the last flip-flop 112.N+1 so that each one of these bits is displayed during a duration that corresponds to their respective weight. During the display duration of the MSB, the selection signal changes value so that the control input of the last flip-flop 112.N+1 no longer receives the display and storage signal but receives the reference electric potential applied on the other input of the multiplexer 118. The pulses coming from the initial storage signal and which are in the display and storage signal are then applied on the N first flip-flops 112.1 to 112.N in order to trigger the storing, in these flip-flops, of the following bits to be displayed. The sequence described hereinabove then starts again using the binary words of the following image.

Figure 7:
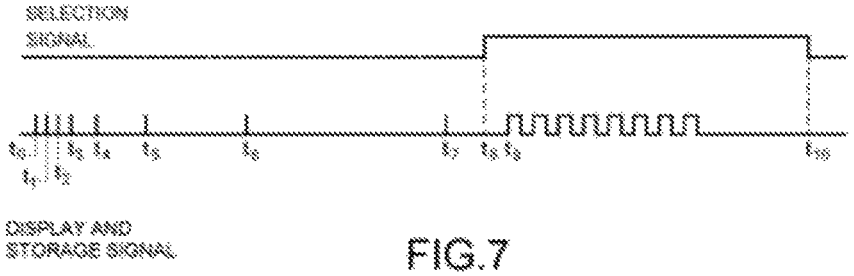
FIG. 7 shows chronograms of signals used in the image display device according to the second embodiment.

FIG. 7 shows the selection signal and the display and storage signal during the display of an image, when the binary words received by the pixels 102 are such that the N bits of each binary word sent successively, in series, to the input of the storage unit 106, are ordered such that the weight of the bits received is increasing with the order of arrival on the input of the storage unit 106, and therefore that the LSB of the binary word is received first and that the MSB of the binary word is received last on the input of the storage unit 106.

As in the first embodiment, this second embodiment is compatible with binary words such that the N bits of each binary word sent successively, in series, to the input of the storage unit 106, are ordered such that the weight of the bits received is decreasing with the order of arrival on the input of the storage unit 106, and therefore that the MSB of the binary word is received first and that the LSB of the binary word is received last on the input of the storage unit 106.

In the second embodiment described hereinabove, the display and storage signal is obtained by carrying out an OR logic operation between the display signal and the storage signal within the sequencing unit 108. Thus, the storage unit 106 comprises only two control inputs on which the display and storage signal, and the selection signal are received.

Alternatively, the logic operation that makes it possible to obtain the display and storage signal could be carried out within the pixels 102, or be obtained from the display signal and from the storage signal by using one or several elements other than an OR gate, in the sequencing unit 108 or outside of the sequencing unit 108.

Alternatively, the storage unit 106 of each pixel 102 may comprise a number of flip-flops 112 less than N+1 and greater than or equal to 3, as was described hereinabove for the first embodiment.

Figure 8:
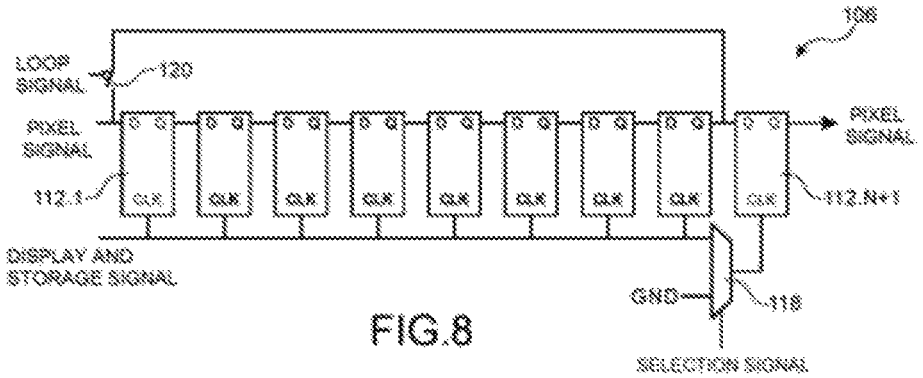
FIG. 8 shows an embodiment of a storage unit of a pixel of an image display device according to an alternative of the second embodiment.

According to an alternative of the two embodiments described hereinabove in relation with FIGS. 3 and 6, it is possible, in the storage unit 106 of the pixel 102, to couple the output of the last of the N first flip-flops 112.N to the input of the first flip-flop 112.1 through a switch 120 controlled by the sequencing unit 108, via a loop signal applied on the switch 120, which is configured to close the switch 120 when the binary word of the image displayed is similar to the binary word of the following image to be displayed. When the switch 120 is in the closed position and the pulses of the storage signal are applied on the control inputs of the flip-flops 112.1 to 112.N, the values stored in the flip-flops 112.1 to 112.N are successively stored in the last flip-flop 112.N+1 but are also copied in the flip-flops 112.1 to 112.N. FIG. 8 shows such an alternative applied to the second embodiment described hereinabove in relation with FIG. 6.

Figure 9:
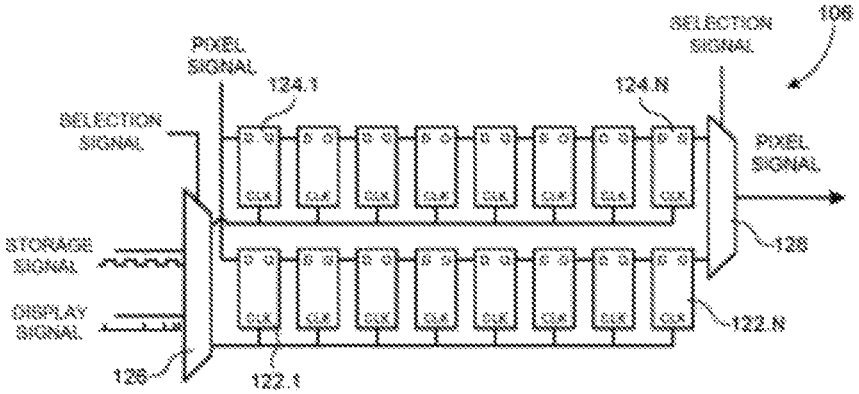
FIG. 9 shows an embodiment of a storage unit of a pixel of an image display device according to a third embodiment.

FIG. 9 shows an embodiment of the storage unit 106 of each pixel 102 of the device 100 according to a third embodiment.

In this third embodiment, the storage unit 106 of each pixel 102 comprises N first flip-flops 122.1 to 122.N coupled in series to one another. A data input of a first of the N first flip-flops 122.1 is coupled to an input of the pixel 102 intended to receive the binary words of the images to be displayed.

The storage unit 106 also comprises N second flip-flops 124.1 to 124.N coupled in series to one another. A data input of a first of the N second flip-flops 124.1 is coupled to the input of the pixel 102.

As in the preceding embodiments, the display unit 104 here comprises a single light-emitting diode and the storage unit 106 here comprises a single input configured to receive the binary words of the images to be displayed.

The storage unit 106 also comprises a switching circuit 126 comprising two data inputs coupled to the sequencing unit 108. A first of these two data inputs is intended to receive the display signal and a second of these two data inputs is intended to receive the storage signal. The switching circuit 126 also comprises a control input coupled to the third output of the sequencing unit 108 on which the selection signal is intended to be sent. The switching circuit 126 also comprises a first output coupled to a control input of each one of the N first flip-flops 122.1 to 122.N and a second output coupled to a control input of each one of the N second flip-flops 124.1 to 124.N. This switching circuit 126 is such that according to the value of the selection signal applied on the control input thereof, the circuit 126 is in one of the following two configurations:

- the first output is coupled to the first data input and the second output is coupled to the second data input, or
- the first output is coupled to the second data input and the second output is coupled to the first data input.

The storage unit 106 further comprises a multiplexer 128 comprising two data inputs of which one is coupled to the output of a last of the N first flip-flops 122.N and of which the other is coupled to the output of a last of the N second flip-flops 124.N. The multiplexer 128 also comprises a control input coupled to the third output of the sequencing unit on which the selection signal is outputted, and an output coupled to the input of the display unit 104.

In such a configuration, the signals sent by the sequencing unit 108 are such that when the N first flip-flops 122 receive on their control inputs the display signal, the output of the multiplexer 128 is coupled to the data input which is coupled to the output of the last of N first flip-flops 122.N. Thus the bits stored in the N first flip-flops 122 are successively displayed by the display unit 104 on the control of the pulses of the display signal. During the display of one or several of the bits stored in the N first flip-flops 122, the switching circuit 126 sends the storage signal on the control inputs of the N second flip-flops 124 which store the bits of the binary word applied on the input of the first of the N second flip-flops 124.1.

At the end of the display of the N bits stored in the N first flip-flops 122, the selection signal changes value, thus inverting the role of the N first flip-flops 122 and of the N second flip-flops 124. The N second flip-flops 124 receive on their control inputs the display signal, and the output of the multiplexer 128 is coupled to the data input which is coupled to the output of the last of N second flip-flops 124.N. Thus the bits stored in the N second flip-flops 124 are successively displayed by the display unit 104 on the control of the pulses of the display signal. During the display of one or several of the bits stored in the N second flip-flops 124, the switching circuit 126 sends the storage signal on the control inputs of the N first flip-flops 122 which store the bits of the binary word applied on the input of the first of the N first flip-flops 122.1.

At the end of the display of the N bits stored in the N second flip-flops 124, the selection signal again changes value, inverting the role of the N first flip-flops 122 and of the N second flip-flops 124.

The N first flip-flops 122 and the N second flip-flops 124 therefore alternatively fulfil the role of storage wherein the bits of the binary word of the next image to be displayed are stored and the role of storage from which the bits of the binary word of an image to be displayed are sent to the display unit 104.

As in the preceding embodiments, this third embodiment is compatible with binary words such that the N bits of each binary word sent successively, in series, to the input of the storage unit 106, are ordered such that the weight of the bits received is decreasing with the order of arrival on the input of the storage unit 106, and therefore that the MSB of the binary word is received first and that the LSB of the binary word is received last on the input of the storage unit 106, or such that the weight of the bits received is increasing with the order of arrival on the input of the storage unit 106, and therefore that the LSB of the binary word is received first and that the MSB of the binary word is received last on the input of the storage unit 106.

Alternatively, the storage unit 106 of each pixel 102 may comprise less than 2.N flip-flops 122, 124, with at least two first flip-flops 122 and at least two second flip-flops 124, as described hereinabove in relation with the first embodiment.

Figure 10:
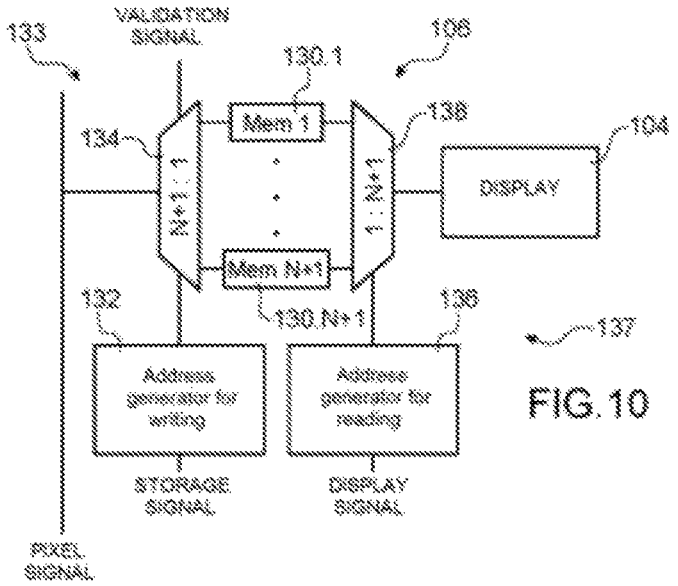
FIG. 10 shows an embodiment of a storage unit of a pixel of an image display device according to a fourth embodiment, FIG. 11 diagrammatically shows an embodiment of a pixel of an image display device according to a particular embodiment, FIG. 12 diagrammatically shows a top view of an image display device according to a particular embodiment, FIGS. 13 and 14 diagrammatically show particular configurations of a pixel of an image display device according to a particular embodiment, FIG. 15 diagrammatically shows an embodiment of a storage unit coupled to two light-emitting diodes of a display unit of a pixel of an image display device according to a particular embodiment.

FIG. 10 shows an embodiment of the storage unit 106 of each pixel 102 of the device 100 according to a fourth embodiment.

The storage unit 106 comprises N+1 storage elements 130.

The storage unit 106 also comprises a first addressing circuit 133 comprising a data input coupled to an input of the pixel 102 intended to receive the binary words of the images to be displayed, N+1 outputs each one coupled to an input of one of the N+1 storage elements 130, and at least one control input coupled to at least one first output of the sequencing unit 108 on which the storage signal is intended to be outputted.

According to a first configuration corresponding to that shown in FIG. 10, the first addressing circuit 133 comprises a first address generator 132 comprising an input coupled to the first output of the sequencing unit 108 on which the storage signal is intended to be outputted.

The first addressing circuit 133 further comprises a demultiplexer 134 comprising a data input coupled to the input of the pixel 102 intended to receive the binary words of the images to be displayed, N+1 outputs each one coupled to an input of one of the N+1 storage elements 130, and a control input coupled to an output of the first address generator 132. In this particular embodiment, the demultiplexer 134 also comprises a second control input on which a validation signal is applied, authorising or not authorising the transfer of data from the input of the demultiplexer 134 to an output of the demultiplexer 134.

The storage unit 106 also comprises a second addressing circuit 137 comprising N+1 data inputs each one coupled to an output of one of the N+1 storage elements 130, an output coupled to an input of the display unit 104, and at least one control input coupled to at least one second output of the sequencing unit 108 on which the display signal is intended to be outputted.

According to the first configuration, the second addressing circuit 137 comprises a second address generator 136 comprising an input coupled to the second output of the sequencing unit 108 on which the display signal is intended to be outputted.

The second addressing circuit 137 also comprises a multiplexer 138 comprising N+1 data inputs each one coupled to an output of one of the N+1 storage elements 130, an output coupled to the input of the display unit 104, and a control input coupled to an output of the second address generator 136.

As in the preceding embodiments, the display unit 104 comprises a light-emitting diode and the storage unit 106 comprises a single input configured to receive the binary words of the images to be displayed.

With such a storage unit 106, during the storage of one of the N bits of a binary word triggered by the storage signal, the first address generator 132 outputs to the demultiplexer 134 a first address signal encoding over several bits the address of one of the N+1 storage elements 130 wherein said one of the N bits of the binary word is stored. Furthermore, during the display of one of the N bits of a binary word triggered by the display signal, the second address generator 136 outputs to the multiplexer 138 a second address signal encoding over several bits the address of one of the N+1 storage elements 130 from which one of the N bits of the binary word is read. As in the preceding embodiments, the storage of the bits of a binary word of an image to be displayed is carried out during the display of a bit by the display unit, even during the display of several bits by the display unit as is the case for the third embodiment described hereinabove.

The first and second address generators 132, 136 correspond for example to pseudo-random generators configured to output signals encoded over several bits corresponding to the addresses of the storage elements 130.

According to a second configuration, it is possible that the sequencing unit 108 be configured such that the storage signal is formed from several first addressing signals each one controlling a storage in one of the storage elements 130. In this case, the first addressing circuit 133 does not comprise the first address generator 132 since the write addressing is carried out directly by these first addressing signals.

In this second configuration, the sequencing unit 108 may be configured such that the display signal is formed from several second addressing signals each one controlling a reading of a bit stored in one of the storage elements 130. In this case, the second addressing circuit 137 does not comprise the second address generator 136 since the read addressing is carried out directly by the second addressing signals.

This second configuration makes it possible to save the active surface occupied by the first and second address generators 132, 136, with however for counterparty increasing the number of interconnections connected to the pixels 102.

According to a third configuration, the first addressing circuit 133 may comprise a first counter comprising an input coupled to the first output of the sequencing unit 108, and a first address decoder comprising a data input coupled to the input of the pixel 102 intended to receive the binary words, several outputs each one coupled to the input of one of the storage elements 130, and a control input coupled to an output of the first counter. Similarly, the second addressing circuit 137 comprises a second counter comprising an input coupled to the second output of the sequencing unit 108, a second address decoder comprising several data inputs each one coupled to the output of one of the storage elements 130, an output coupled to the input of the display unit 104, and a control input coupled to an output of the second counter.

The various configurations of the fourth embodiment may be combined together, i.e. the first addressing circuit 133 may be made according to one of the first, second and third configurations, and the second addressing circuit 137 may be made according to another of these three configurations.

This fourth embodiment has for advantage to allow for the choice of the order wherein the reading and the writing are carried out in the storage elements 130.

As in the preceding embodiments, this fourth embodiment is compatible with binary words such that the N bits of each binary word sent successively, in series, to the input of the storage unit 106, are ordered such that the weight of the bits received is decreasing with the order of arrival on the input of the storage unit 106, and therefore that the MSB of the binary word is received first and that the LSB of the binary word is received last on the input of the storage unit 106, or such that the weight of the bits received is increasing with the order of arrival on the input of the storage unit 106, and therefore that the LSB of the binary word is received first and that the MSB of the binary word is received last on the input of the storage unit 106, or any other order.

As an alternative of the fourth embodiment described hereinabove, it is possible that the storage unit 106 comprises N storage elements 130.

In the various embodiments described hereinabove, the phase of storing bits of the binary words is preferably executed during the display of a bit corresponding to an MSB. Thus, the duration available for carrying out the storage of the N bits in the storage unit 106 is equivalent to half of the duration of display of one image. Alternatively, it is however possible that this phase of storing be executed during the display of a bit other than an MSB. This is the case when several successive phases of storing are implemented in order to carry out the storing of the bits of a single binary word.

In addition, for all of the embodiments, the order of storing and/or of reading bits does not necessarily correspond to the increasing order (from the LSB to the MSB) or decreasing order (from the MSB to the LSB) of the weight of the bits, the bits able to be read and/or stored according to an order.

According to another alternative, it is possible that the storage phase of the bits of binary words is executed during a portion only of the display duration of a bit, for example during half of the duration of the MSB. Such an alternative may be implemented by using a storage unit 106 wherein the output of the $N^{th}$ flip-flop 112.N is re-looped on the data input of the first flip-flop 112.1, as is the case in FIG. 8. By using for example the first half of the duration of the MSB to carry out the storage phase, the switch 120 is closed during this phase so that the value of the MSB is reloaded in the first flip-flop 112.1 after the storing of the other bits. The second half of the duration of the MSB is then displayed after the display of the other bits. Such an alternative may also be implemented by adding an additional flip-flop that makes it possible to store the value of the bit which is displayed over two non-consecutive duration halves, which makes it possible to have two flip-flops that store the value of this bit.

In the various embodiments and alternatives described hereinabove, each pixel 102 comprises a display unit 104 comprising a light-emitting diode. However, for each one of these embodiments and each one of the alternatives, the display unit 104 of each pixel 102 may comprise several light-emitting diodes. Indeed, each pixel 102 is intended to display an elementary point of an image that may correspond to a light signal emitted by a single light-emitting diode, or which may correspond to the sum of several light signals emitted by several light-emitting diodes, as is the case for a colour display device.

When the display unit 104 of each pixel 102 comprises M light-emitting diodes, the storage unit 106 of each pixel 102 comprises a number of inputs configured to receive the binary words of the images to be displayed by the display unit 104 which is greater than or equal to 1 and which is less than or equal to M, with M corresponding to a whole number greater than or equal to 1. It is for example possible to have as many light-emitting diodes as inputs configured to receive the binary words of the images to be displayed, for example 4.

Figure 13:
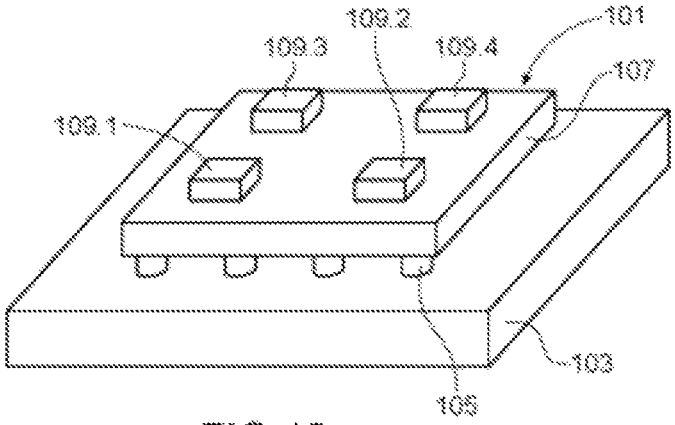

FIG. 13 diagrammatically shows a configuration wherein each pixel 102 is made in the form of a module 101 made and hybridised on a substrate 103 and comprising several second portions 109.1-109.4 forming the emissive portions (for example light-emitting diodes) of the module 101 (four on the example of FIG. 13, with for example one emitting a red light, another emitting a blue light, and the two others emitting a green light) and arranged on a first portion 107 that is common to the second portions 109 of the module 101. The first portion 107 comprises electronic elements made in CMOS technology, forming in particular the storage unit 106 of the pixel 102 as well as the control element of each one of the diodes of the pixel 102.

In this configuration, the storage unit 106 formed in the first portion 107 is configured to store at least some of the bits of the binary words intended to be displayed by the light-emitting diodes of the module.

This configuration has in particular for advantage to reduce the number of electrical connections dedicated to the control of the pixel 102 (corresponding to the signals other than the data signal, i.e. the binary words of the image to be displayed) to be made between the substrate 103 and the first portion 107 of the module 101, due to the fact that these connections are mutualised by the light-emitting diodes of the module 101.

Figure 14:
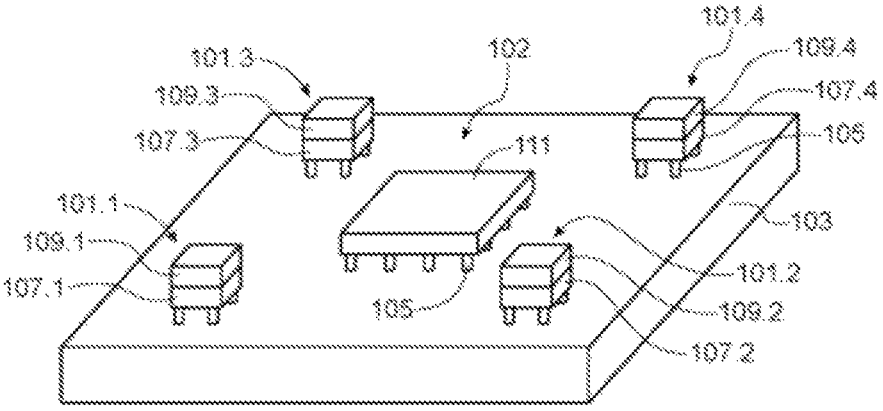

In another configuration, it is possible that a portion of the storage unit 106 of a pixel 102 is not formed in the first portions 107 of the module or modules 101 of this pixel 102, but is formed in an electronic circuit 111 separate from the modules 101 and hybridised on the substrate 103, next to the module or modules 101 that form the light-emitting diode or diodes of the pixel 102. FIG. 14 shows such a configuration wherein four modules 101.1-101.4 each one forming one of the four light-emitting diodes of a pixel 102 are hybridised on a substrate 103 by connection elements 105. The storage unit 106 in which are stored the binary words of the pixel 102 comprises elements or components distributed in the first portions 107 of the four modules 101.1-101.4 as well as in the hybridised circuit 111 on the substrate 103 thanks to connectors 105. In this case, the first portion 107 of each one of the modules 101 comprising one of the light-emitting diodes ensures the storage of at least one of the bits of the binary word to be displayed, and comprises for example at least one flip-flop or any other element (for example a capacity) that ensures this storage. The circuit 111 may also form at least one portion of the sequencing unit 108.

Regardless of the embodiment or the alternative embodiment of the device 100, the first portion 107 of each module 101 of a pixel 102 carries out a storage of at least one bit of a binary word to be displayed.

In addition, regardless of the embodiment or the alternative embodiment of the device 100, the number of control signals (signals other than the data signal or signals comprising the binary words to be displayed) received by each pixel 102 through the connection elements 105 is less than the number of storage elements N (flip-flops 112 or storage elements 130 for the examples described hereinabove) of the pixel 102. Advantageously, the number of connection elements 105 is less than N/2, even between 5 and 10. As an example, each module 101 may be coupled to the substrate 103 through at least 5 connection elements (and equal to 5 when the module 101 comprises a single light-emitting diode): one dedicated to conveying the supply electric potential, one dedicated to conveying a reference electric potential, one dedicated to the selection signal, one dedicated to the display and storage signal, one dedicated to the data signal to be displayed.

In the configurations described hereinabove, each storage unit 106 may be coupled to several light-emitting diodes of a display unit 104 so as to store the binary words to be displayed by these light-emitting diodes. When the storage units 106 are made according to one of the first, second or third embodiments described hereinabove, the number of flip-flops 112 described hereinabove for each pixel 102 may be multiplied by the number of light-emitting diodes to which each storage unit 106 is coupled. When the storage units 106 are made according to the fourth embodiment described hereinabove, the number of storage elements 130 described hereinabove for each pixel 102 may be multiplied by the number of light-emitting diodes to which each storage unit 106 is coupled.

Figure 15:
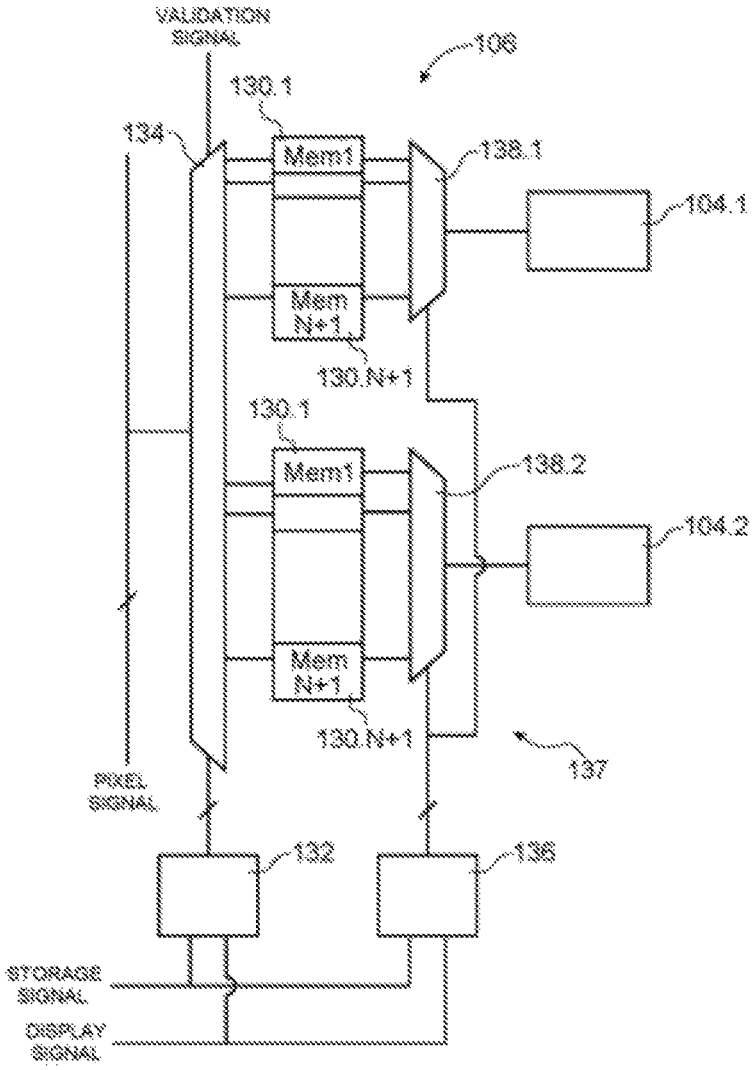

FIG. 15 show an embodiment of a storage unit 106 coupled to two light-emitting diodes 104.1 and 104.2 of the same pixel 102. In this example, the storage unit 106 is mutualised and is associated with two light-emitting diodes. The storage unit 106 comprises two groups of storage elements 130.1-130.N+1 each one associated with one of the light-emitting diodes 104.1, 104.2.

The storage unit 106 also comprises the first address generator 132 comprising inputs coupled to the outputs of the sequencing unit 108 on which the storage signal and the display signal are intended to be outputted.

The storage unit 106 further comprises the first addressing circuit 133 for example made according to the first configuration, i.e. formed by the demultiplexer 134 comprising a data input coupled to an input of the pixel 102 intended to receive the binary words of images, several sets of N+1 outputs (two times N+1 outputs on the example of FIG. 15) each one coupled to an input of one of the storage elements 130, and a control input coupled to an output of the first address generator 132.

The storage unit 106 also comprises the second addressing circuit 137 for example formed by the second address generator 136 comprising inputs coupled to the outputs of the sequencing unit 108 on which the storage signal and the display signal are intended to be outputted.

The second addressing circuit 137 also comprises two multiplexers 138.1, 138.2 each one comprising N+1 data inputs each one coupled to an output of one of the storage elements 130, an output coupled to the input of the display unit 104 that it is associated with, and a control input coupled to an output of the second address generator 136.

The operation of this storage unit 106 is similar to that of the storage unit 106 described hereinabove in relation with FIG. 10, except that the storage unit 106 here carries out the storage of the bits for two light-emitting diodes 104.

The invention claimed is:

1. An image display device comprising at least one matrix of pixels, wherein each pixel comprises:

one display unit configured to emit, during the display by the matrix of pixels of an image encoded in the form of several binary words of a binary coded modulation (BCM) type comprising N bits, with N a whole number greater than or equal to 2, at least one light signal for a duration that corresponds to a value encoded in one of the binary words of the image, with each one of the N bits of said one of the binary words of the image representing a duration of the display of the light signal that is proportional to the weight of the bit, one storage unit configured to store at least three bits, comprising an output coupled with an input of the display unit, and an input configured to receive the binary words of the images to be displayed by said display unit, the image display device further comprising a sequencing unit configured to output to the storage unit of each pixel, during the display of a first image by the matrix of pixels:

a storage signal that triggers, during the display of one of the bits of one of the binary words of the first image by the display unit of the pixel, a storage of at least two other bits of at least one of one of the binary words of a second image intended to be displayed after the first image and of said one of the binary words of the first image, in said storage unit of the pixel, a display signal that triggers the successive sending of each one of the bits of said one of the binary words of the first image stored in the storage unit of the pixel to the display unit of the pixel.

2. The image display device according to claim 1, wherein the sequencing unit is configured to trigger the storage during the display of the most significant bit of said one of the binary words of the first image.

3. The image display device according to claim 1, wherein the storage unit of each pixel comprises at least three flip-flops coupled in series to one another and such that an input from a first of the flip-flops is coupled to an input of the pixel intended to receive the binary words, and such that an output from a last of the flip-flops is coupled to an input of the display unit.

4. The image display device according to claim 3, wherein:

the storage unit of each pixel further comprises at least one multiplexer comprising at least:

a) two data inputs of which one is coupled to a first output of the sequencing unit on which the display signal is intended to be sent and of which the other is coupled to a second output of the sequencing unit on which the storage signal is intended to be sent, b) one output coupled to a control input of each one of at least two first flip-flops of the storage unit corresponding to those, among the flip-flops of the storage unit, in which said at least two other bits of at least one of one of the binary words of the second image and of said one of the binary words of the first image are intended to be stored during said display of one of the bits of one of the binary words of the first image, c) one control input coupled to a third output of the sequencing unit on which a selection signal is intended to be sent, making it possible to couple the output of the multiplexer to one or the other of the two data inputs of the multiplexer according to the value of the selection signal, one control input of the last of the flip-flops of the storage unit of each pixel is coupled to the first output of the sequencing unit, the sequencing unit is configured such that, for each pixel, the selection signal controls the multiplexer such that during said display of one of the bits of one of the binary words of the first image, the storage signal is outputted on the output of the multiplexer and triggers the storage of said at least two other bits of at least one of one of the binary words of the second image and of said one of the binary words of the first image, and for the display of the other stored bits, the display signal is outputted on the output of the multiplexer and triggers the successive displays of each one of the other stored bits.

5. The image display device according to claim 3, wherein:

the sequencing unit outputs over a single output the display signal and the storage signal in the form of a single and same signal named display and storage signal, said output being coupled to a control input of each one of at least two first flip-flops of the storage unit corresponding to those, among the flip-flops of the storage unit, in which said at least two other bits of at least one of one of the binary words of the second image and of said one of the binary words of the first image are stored during said display of one of the bits of one of the binary words of the first image, the storage unit of each pixel further comprises at least one multiplexer comprising two data inputs, of which one is coupled to the output of the sequencing unit on which the display and storage signal is intended to be outputted and of which the other is coupled to a reference electric potential, one control input coupled to a third output of the sequencing unit on which a selection signal is intended to be sent and making it possible to couple the output of the multiplexer to one or the other of the two data inputs of the multiplexer according to the value of the selection signal, and an output coupled to a control input of the last of the flip-flops of the storage unit, the sequencing unit is configured such that, for each pixel, the selection signal controls the multiplexer such that during said display of one of the bits of one of the binary words of the first image, the reference electric potential is outputted on the output of the multiplexer while the display and storage signal applied on the control input of each one of the first flip-flops of the storage unit triggers the storage of said at least two other bits of at least one of one of the binary words of the second image and of said one of the binary words of the first image, and for the display of the other stored bits, the display and storage signal is applied on the control inputs of the flip-flops of the storage unit and triggers the successive displays of each one of the other stored bits.

6. The image display device according to claim 3, wherein:

the storage unit of each pixel further comprises at least:

a) one OR gate comprising two inputs coupled to first and second outputs of the sequencing unit on which the display and storage signals are intended to be sent, and of which one output is coupled to a control input of each one of at least two first flip-flops of the storage unit corresponding to those, among the flip-flops of the storage unit, in which said at least two other bits of at least one of one of the binary words of the second image and of said one of the binary words of the first image are intended to be stored during said display of one of the bits of one of the binary words of the first image, b) one multiplexer comprising two data inputs of which one is coupled to the output of the OR gate and of which the other is coupled to a reference electric potential, one control input coupled to a third output of the sequencing unit on which a selection signal is intended to be sent and making it possible to couple the output of the multiplexer to one or the other of the two data inputs of the multiplexer according to the value of the selection signal, and an output coupled to a control input of the last of the flip-flops of the storage unit, the sequencing unit is configured such that, for each pixel, the selection signal controls the multiplexer such that during said display of one of the bits of one of the binary words of the first image, the reference electric potential is outputted on the output of the multiplexer while the storage signal applied on the control input of each one of the first flip-flops of the storage unit triggers the storage of said at least two other bits of at least one of one of the binary words of the second image and of said one of the binary words of the first image, and for the display of the other stored bits, the signal obtained at the output of the OR gate is applied on the control inputs of the flip-flops of the storage unit and triggers the successive displays of each one of the other stored bits.

7. The image display device according to claim 3, wherein, in each pixel, the output of the last of the first flip-flops of the storage unit of the pixel is coupled to the input of the first of the flip-flops of the storage unit of the pixel through a switch controlled by the sequencing unit which is configured to close the switch when the binary word of the first image is similar to the binary word of the second image.

8. The image display device according to claim 1, wherein:

the storage unit of each pixel comprises:

a) at least two first flip-flops coupled in series to one another and such that a data input of a first of said at least two first flip-flops is coupled to an input of the pixel intended to receive the binary words, b) at least two second flip-flops coupled in series to one another and such that a data input of a first of said at least two second flip-flops is coupled to said input of the pixel, c) a switching circuit comprising two data inputs, of which one is coupled to a first output of the sequencing unit on which the display signal is intended to be sent and of which the other is coupled to a second output of the sequencing unit on which the storage signal is intended to be sent, one control input coupled to a third output of the sequencing unit on which a selection signal is intended to be sent, a first output coupled to a control input of each one of the first flip-flops and a second output coupled to a control input of each one of the second flip-flops, and configured such that according to the value of the selection signal, the first output is coupled to the first data input and the second output is coupled to the second data input, or the first output is coupled to the second data input and the second output is coupled to the first data input, d) one multiplexer comprising two data inputs of which one is coupled to the output of a last of said at least two first flip-flops and of which the other is coupled to the output of a last of said at least two second flip-flops, a control input coupled to the third output of the sequencing unit, and an output coupled to an input of the display unit, the sequencing unit is configured such that, for each pixel, the selection signal controls the switching circuit and the multiplexer such that during said display of one of the bits of one of the binary words of the first image via the first flip-flops, the storage signal is applied on the control inputs of the second flip-flops and triggers the storage of said at least two other bits of at least one of one of the binary words of the second image and of said one of the binary words of the first image in the second flip-flops.

9. The image display device according to claim 1, wherein the storage unit of each pixel comprises:

at least three storage elements each comprising an input on which a bit to be stored is intended to be applied and an output on which a stored bit is intended to be outputted, a first addressing circuit comprising a data input coupled to an input of the pixel intended to receive the binary words of the images to be displayed, at least three outputs each one coupled to an input of one of the storage elements, and at least one control input coupled to at least one first output of the sequencing unit on which the storage signal is intended to be outputted, a second addressing circuit comprising at least three data inputs each one coupled to an output of one of the storage elements, an output coupled to an input of the display unit, and at least one control input coupled to at least one second output of the sequencing unit on which the display signal is intended to be outputted, and wherein the sequencing unit is configured such that, for each pixel:

during the storage of a bit triggered by the storage signal, the first addressing circuit applies on the input of one of the three storage elements the bit received on its data input, during the display of one of the stored bits triggered by the display signal, the second addressing circuit applies on an input of the display unit one of the stored bits in the three storage elements.

10. The image display device according to claim 9, wherein the first addressing circuit comprises:

a first address generator comprising an input coupled to the first output of the sequencing unit, a demultiplexer comprising a data input coupled to the input of the pixel intended to receive the binary words of the images to be displayed, at least three outputs each one coupled to the input of one of the storage elements, and a control input coupled to an output of the first address generator, wherein the second addressing circuit comprises:

a second address generator comprising an input coupled to the second output of the sequencing unit, a multiplexer comprising at least three data inputs each one coupled to the output of one of the storage elements, an output coupled to the input of the display unit, and a control input coupled to an output of the second address generator, and wherein the sequencing unit is configured such that, for each pixel:

during the storage of a bit triggered by the storage signal, the first address generator outputs to the demultiplexer a first address signal encoding over several bits the address of one of the storage elements in which said bit is intended to be stored, during the display of one of the stored bits triggered by the display signal, the second address generator outputs to the multiplexer a second address signal encoding over several bits the address of one of the storage elements from which said one of the stored bits is read.

11. The image display device according to claim 9, wherein the sequencing unit is configured such that the storage signal is formed from at least three first addressing signals each one controlling a storage in one of the storage elements, and such that the display signal is formed from at least three second addressing signals each one controlling a reading of a bit stored in one of the storage elements.

12. The image display device according to claim 9, wherein the first addressing circuit comprises:

a first counter comprising an input coupled to the first output of the sequencing unit, a first address decoder comprising a data input coupled to the input of the pixel intended to receive the binary words, at least three outputs each one coupled to the input of one of the storage elements, and a control input coupled to an output of the first counter, wherein the second addressing circuit comprises:

a second counter comprising an input coupled to the second output of the sequencing unit, a second address decoder comprising at least three data inputs each one coupled to the output of one of the storage elements, an output coupled to the input of the display unit, and a control input coupled to an output of the second counter.

13. The image display device according to claim 1, wherein:

the storage unit is configured to store at least N+1 bits; and during said display of one of the bits of one of the binary words of the first image, the storage signal triggers the storage of the N bits of the binary word of the second image or the storage of N−1 bits of the binary word of the first image and of one bit of the binary word of the second image.

14. The image display device according to claim 1, wherein the display unit of each pixel comprises M light-emitting diodes, and wherein the storage unit of each pixel comprises a number of inputs configured to receive the binary words of the images to be displayed by the display unit of the pixel which is greater than or equal to 1 and which is less than or equal to M, with M corresponding to a whole number greater than or equal to 1.

15. The image display device according to claim 1, wherein the pixels are formed by modules made on a substrate, with each module comprising at least:

one first portion located on the side of the substrate and forming an electronic circuit comprising at least the storage unit of the pixel;

a second portion such that the first portion is arranged between the substrate and the second portion, and forming at least one portion of the display unit of the pixel.

16. The image display device according to claim 15, wherein:

the second portion of each module corresponds to a single light-emitting diode, or each module comprises several second portions each one forming a light-emitting diode and arranged on a first portion common to said several second portions.

17. The image display device according to claim 15, wherein each pixel comprises a single module, or wherein each pixel comprises several modules and an electronic circuit coupled to the substrate, next to said several modules, and forming a portion of the storage unit of the pixel.

18. A method for image display by an image display device including at least one matrix of pixels, carrying out a successive display of images each one encoded in the form of several binary words of a binary coded modulation (BCM) type encoded over N bits, with N a whole number greater than or equal to 2, each pixel displaying, during the display of an image, at least one light signal during a duration corresponding to a value encoded in at least one of the binary words of the image, each one of the N bits of said at least one of the binary words of the image representing a duration of display that is proportional to the weight of the bit, the method comprising:

storing, during the display of one of the bits of one of the binary words of the first image by the display unit of the pixel and for each pixel, in a storage unit arranged in the pixel and comprising an input configured to receive the binary words of the images to be displayed, of at least two other bits of at least one of one of the binary words of a second image intended to be displayed after the first image and of said one of the binary words of the first image.

19. The method for image display according to claim 18, wherein said at least two other bits of at least one of one of the binary words of the second image and of said one of the binary words of the first image are stored sequentially in the storage unit during said display of one of the bits of one of the binary words of the first image.

* * * * *